United States Patent [19]

Goggi

[11] 3,976,040

[45] Aug. 24, 1976

[54] APPARATUS AND METHOD FOR MIXING AND DISPERSING ENGINE DRAINAGE INTO THE FUEL FLOW TO AN ENGINE

[75] Inventor: Charles P. Goggi, Staten Island, N.Y.

[73] Assignee: Goggi Corporation, Staten Island, N.Y.

[22] Filed: Aug. 1, 1974

[21] Appl. No.: 493,902

[52] U.S. Cl. ..... 123/73 AD; 123/73 A

[51] Int. Cl.[2] ..... F02B 33/06

[58] Field of Search ..... 123/73 R, 73 A, 73 AD, 123/73 B, 119 B, 141

[56] References Cited

UNITED STATES PATENTS

| | | | |
|---|---|---|---|
| 2,935,057 | 5/1960 | Perlewitz | 123/73 AD |
| 3,132,635 | 5/1964 | Heidner | 123/73 A |
| 3,170,449 | 2/1965 | Goggi | 123/73 A |
| 3,528,395 | 9/1970 | Goggi | 123/73 AD |
| 3,834,365 | 9/1974 | Ussery | 123/119 B |

*Primary Examiner*—Wendell E. Burns
*Assistant Examiner*—David D. Reynolds
*Attorney, Agent, or Firm*—Kenyon & Kenyon Reilly Carr & Chapin

[57] ABSTRACT

Apparatus and method for use associated with an internal combustion engine whereby drainage of fuel, vapor and oil drainage from the crankcase thereof is recovered and introduced in a metered fashion into the principal fuel line of the engine. A dual-chambered device is employed having an upper chamber connected to the crankcase for accumulating drainage, and a lower chamber serving as a mixing chamber connected in series with the principal fuel line. At the top of the mixing chamber there is mounted a diffuser plate for receiving and dispersing the drainage as it falls from a valve assembly in the drainage chamber directly above. The diffuser plate acts to disperse the drainage in a thin film over the surface of the plate after which the drainage falls off the sides of the plate and mixes readily with the fuel from the principal fuel supply in the mixing chamber. Also provided across the top of the diffuser plate is a channel which acts as a baffle to enhance the mixing action of the drainage with the fuel.

9 Claims, 3 Drawing Figures

APPARATUS AND METHOD FOR MIXING AND DISPERSING ENGINE DRAINAGE INTO THE FUEL FLOW TO AN ENGINE

BACKGROUND OF THE INVENTION

This invention is concerned with the art of supplying fuel to internal combustion engines. It is more particularly concerned with removing drainage of fuel and oil from the crankcase of the engine and mixing it with fuel from the main fuel supply tank enroute to the intake manifold.

In certain internal combustion engines, such as the two-stroke cycle engine, the crankcase serves as a portion of the engine induction system. There the fuel and air mixture from the carburetor passes through a valving arrangement into the crankcase and subsequently through an intake port to the engine cylinder. The outward stroke of the piston creates a suction condition which causes flow of the fuel-air mixture through a pressure responsive valve into the crankcase. The mixture within the crankcase is pressurized by the inward stroke of the piston so that the mixture flows into the cylinder through the intake port whenever it is exposed by the piston. Thus, the crankcase serves as an intermediate portion of the induction system between the valve arrangement and the cylinder.

During the starting of the engine, as well as during its operation, portions of the vapor in the fuel-air mixture are condensed during passage through the crankcase and accumulate therein. Unsuccessful attempts at starting and excessive choking of the carburetor can add to the accumulation of condensed vapor in the crankcase. In the case of the two-stroke cycle engine where the crankcase serves as a portion of the induction system, it is common practice, for lubrication purposes, to include the lubricating oil in the fuel supply since the fuel and air mixture containing the oil contacts the various operating portions of the engine adjacent the crankcase, as well as the cylinder. With lubricating oil included in the fuel, it is evident that the condensate within the crankcase includes both fuel and lubricating oil.

It is undesirable to have an accumulation of liquid fuel and oil within the crankcase since the liquid can enter a cylinder and become trapped there during the outward stroke of such piston. If sufficient quantities of liquid become trapped in this way between the piston and the cylinder head, "hydraulic lock" will result. This hydraulic lock can be highly destructive to the engine parts due to the incompressible nature of the liquid. Additionally, an accumulation of liquid within the crankcase can vary the fuel-air ratio of the mixture being delivered to the cylinder. This phenomenon can cause faulty operation. Among the difficulties that can arise therefrom are spark-plug fouling, and extremely difficult starting.

To eliminate the accumulation of liquid fuel and lubricating oil in the crankcase of two-stroke cycle engines, drain arrangements have been customarily provided in the crankcase. These drains vent the liquid from the crankcase and release it altogether from the engine. The common way of such release is by means of the exhaust system. A common valving arrangement is to provide valves which are responsive to the fluctuating pressure within the crankcase.

It is obvious that venting this liquid directly from the engine is an inefficient practice, because the liquid is composed of fuel and lubricating oil, i.e., the ingredients of the normal fuel mixture, which, if recovered, can be consumed by the engine. It is equally clear that venting the liquid into the exhaust system causes the escape of unpleasant fumes and vapors as the liquid is swept from the engine along with hot exhaust gas. In addition, their escape in sufficient volume can constitute a significant fire and explosion hazard.

In the case of outboard motors for boats, where the two-stroke cycle is the standard type of engine used, the venting of the liquid directly overboard through the exhaust system which passes underwater can cause contamination of the water upon which the boat is operated.

In one of my previous inventions, now U.S. Pat. No. 3,128,748 and entitled "Apparatus and Method for Recovering Engine Drainage," there is shown a system for delivering the fuel and oil drainage from the engine crankcase to the fuel tank of the engine fuel system. This can be done by utilization of gravity only, or by means of a pump. The latter idea is shown in my application Ser. No. 180,593, filed Mar. 19, 1962, now abandoned and entitled "Apparatus and Method for Pumping Engine Drainage."

These systems, although alleviating the above-described difficulties, led to some complications. Since the lubricating oil mixed with the fuel is much less volatile than the fuel, the proportion of oil in drainage recovered from the crankcase significantly exceeds the proportion of oil in the fuel mixture that is normally delivered to the engine. Thus, the ratio of oil to fuel in the drainage is much higher than that of the fuel mixture recommended by fuel manufacturers.

Experience showed that during operation of an engine having the drainage recovery provisions of my above-described inventions, there is a tendency for the drainage to enter the fuel tank and accumulate near its bottom, since the oil-rich mixture is denser than the normal fuel and oil mixture within the fuel tank. Unless recovered drainage is well distributed within the mixture contained within the fuel tank, areas or "pockets" of liquid with excessive oil content will appear. When this excessively oil-rich mixture is drawn from the fuel tank into the carburetor and intake manifold, it causes an undue accumulation of deposits within the cylinders and on the pistons. This phenomenon also results in greatly shortened spark-plug life and an undesirable amount of smoke in the engine exhaust.

These difficulties were alleviated by the invention described in my U.S. Pat. No. 3,528,395 issued on Sept. 15, 1970 and entitled "Apparatus and Method for Mixing Engine Drainage into the Fuel Flow to an Engine." In this patent, there is disclosed a dual-chambered device located entirely outside of the main fuel tank and employing an upper or drainage chamber connected to the crankcase for accumulating drainage and a lower or mixing chamber connected in series with the principal fuel line. Drainage is dropped through an aperture at the bottom of the drainage chamber directly into the fluid in the mixing chamber. It has been found, however, that with this device the possibility exists of heavy concentrations of the drainage fluid being formed in the mixing chamber.

SUMMARY OF THE INVENTION

It is an object of the present invention to provide a uniform dispersal and mixing of drainage fluid with the fuel and oil mixture from the principal fuel tank. This, and other objects, is achieved by the present invention which consists of a single unit completely external to the fuel tank, this unit having two chambers, one atop the other and sharing a common surface. The bottom chamber is the mixing chamber of the device and has an inlet through which the fuel and oil mixture flows from the principal fuel tank. An outlet from this mixing chamber is connected to the main fuel line of the engine and runs to the carburetor.

On the top of the upper, or drainage, chamber is an inlet through which drainage is piped through a line or hose from the crankcase of the engine. The drainage chamber also has on its upper surface a small opening or vent for air to escape so that drainage may easily enter the chamber. Two small apertures are provided, linking the two chambers through the common surface which serves as the bottom of the drainage chamber and the top of the mixing chamber. A needle valve with an associated float is provided at each aperture to govern the amount of drainage flowing through it into the mixing chamber. When the drainage accumulated in the drainage chamber reaches a certain predetermined level, each needle valve is opened by the action of its respective float, allowing drainage to be slowly metered into the mixing chamber. At the lower end of each aperture is a check valve for preventing any upward fluid flow from the mixing chamber back into the drainage chamber.

At the top of the mixing chamber there is mounted a diffuser plate for receiving and dispersing the drainage as it flows through each aperture in the drainage chamber directly above. The diffuser plate acts to disperse the drainage in a thin film over the top surface of the plate after which the drainage falls off the sides of the plate and mixes readily with the fuel in the mixing chamber. Also provided across the top of the diffuser plate is a channel which acts as a baffle to enhance the mixing action of the drainage with the fuel.

Thus, by means of the dual-chambered device, including the diffuser plate mounted at the top of the mixing chamber, the oil-rich drainage from the crankcase of the engine is uniformly dispersed and mixed with the fuel and oil mixture from the principal fuel tank. This mixed liquid is then drawn by the engine from the outlet of the mixing chamber to the carburetor, and is consumed by the engine.

DESCRIPTION OF THE PREFERRED EMBODIMENT

Figure 1:
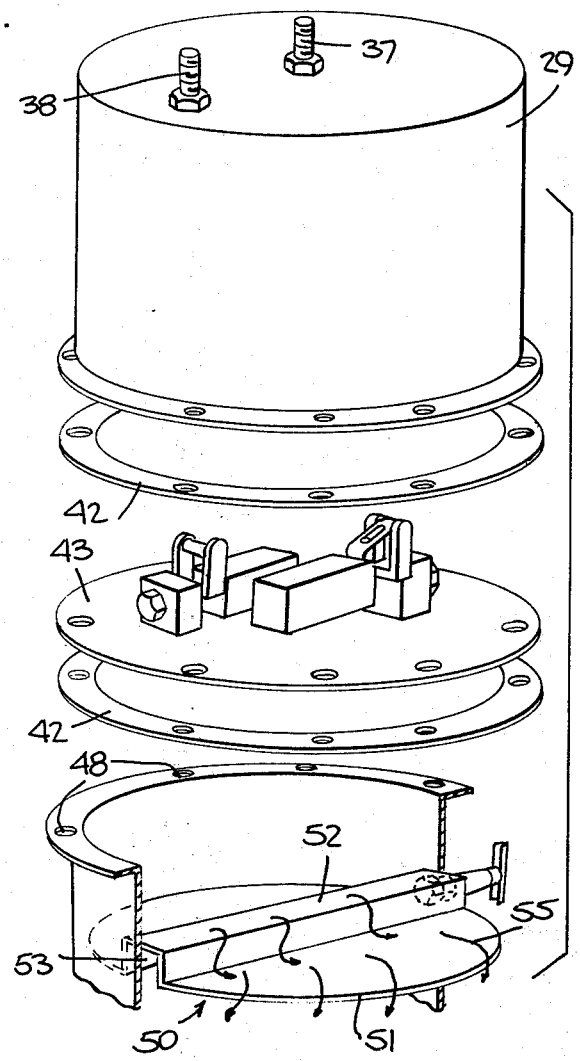
FIG. 1 is a schematic diagram of this invention employed in connection with an outboard motor.

Referring to FIG. 1, this figure contains a schematic diagram of an outboard motor 10 having cylinders 11, crankcase 13, and pistons 12. Fuel is introduced to carburetor 15 through fuel line 24 whence it is vaporized and eventually combusted; however, part of this fuel and oil mixture accumulates in the lower region of the crankcase, escaping through reed drain valve 16 into area 17. If the engine is provided with passage 19 for carrying drainage out of the engine, such as into the exhaust system, passage 19 is blocked in accordance with my U.S. Pat. No. 3,128,748. This drainage is removed from enclosed area 17 by line 23 running to inlet 37 of drainage chamber 29, at which point it enters the chamber.

Figure 3:
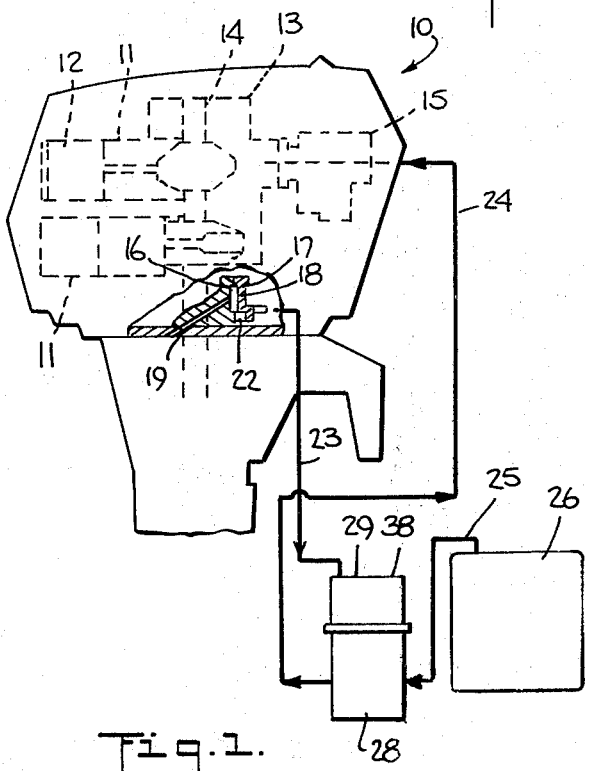
FIG. 3 is a partially exploded, partially cross-sectional view of the unit shown in FIG. 2.
Figure 2:
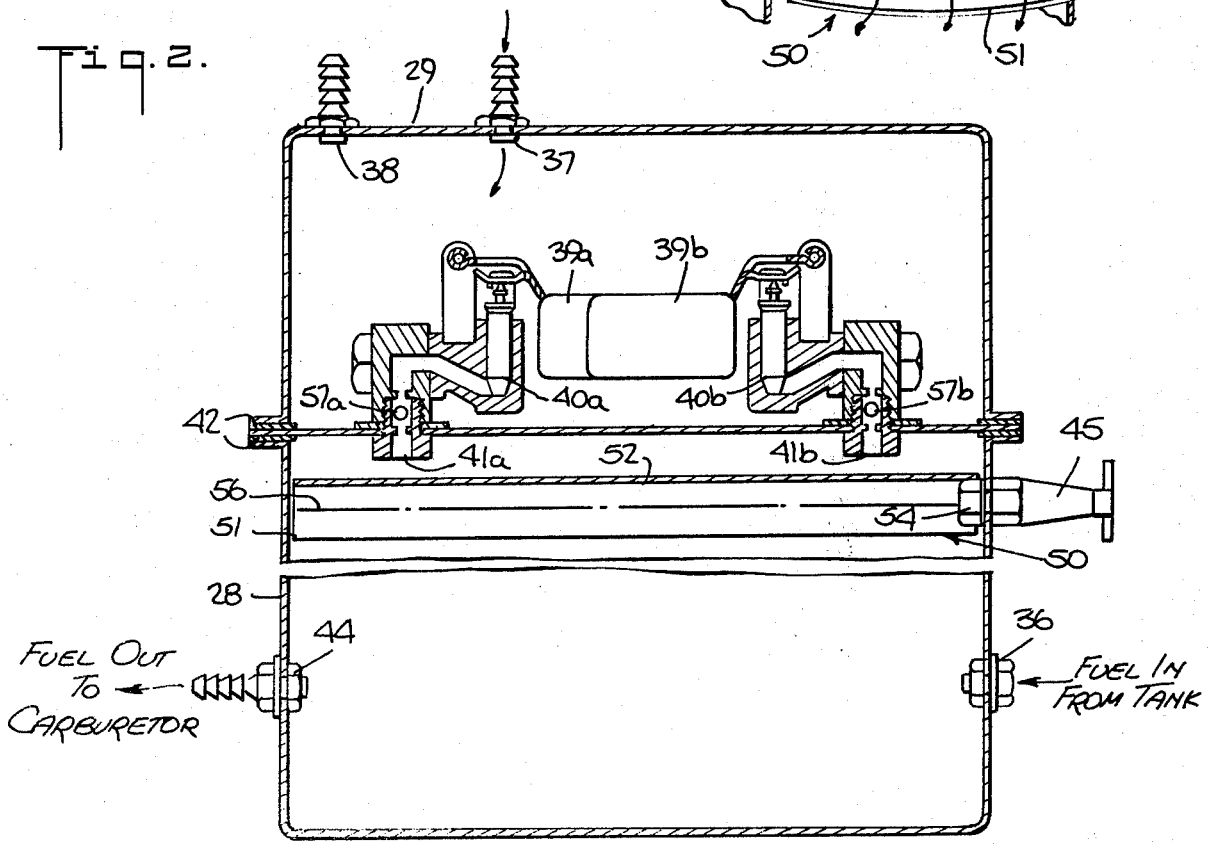
FIG. 2 is a vertical cross-sectional view of a dual chamber unit including in the mixing chamber the diffuser plate, with the appropriate inlets and outlets to and from said chambers.

Referring now to FIGS. 2 and 3, there is shown the two chamber unit including mixing chamber 28 and drainage chamber 29. Through a wall in mixing chamber 28 is provided inlet 36 for receiving fuel from fuel tank 26. Mixing chamber 28 is provided with outlet 44 from which the principal fuel line 24 rns to the carburetor intake. Fuel has access to the mixing chamber by means of line 25 running from inlet 36 to fuel tank 26. Mixing chamber 28 is also provided with normally closed manually operated valve 45, which can be opened to drain the chamber when desired, such as for flushing the system.

The walls of chambers 28 and 29 can be made of any suitable metal or plastic material. Aluminum has been found to be satisfactory. Chambers 28 and 29 are basically cylindrically shaped and made of separate single pieces of metal. Both pieces of metal comprising the walls of the two chambers have, around their open ends, flanges 42 extending outwardly therefrom. These flanges are provided with corresponding holes 48 spaced regularly around their edges. Thus, the two chambers can be connected, open ends facing, by means of screws or bolts and nuts.

Between the two chambers is interposed disc 43 containing around its edges holes corresponding to holes 48. Disc 43 which can be fabricated from aluminum forms the bottom wall of drainage chamber 29 and the top surface of mixing chamber 28. Upon assembly, gaskets 42 can be placed on either side of disc 43 so that the unit will not leak when it is fastened together.

Disc 43 is provided with two openings 41 *a,b* into each of which is fitted a commercially available needle valve assembly 40 *a* and 40 *b*, respectively. Assembly 40 *a* is identical in parts and operation to the assembly 40 *b*. The action of each needle valve assembly 40 *a,b* is governed by their respective float 39 *a,b* attached thereto. When drainage enters drainage chamber 29 by means of drainage line 23 and inlet 37, it accumulates at the bottom of chamber 29 until a predetermined level of drainage accumulates. When the predetermined level of drainage is reached, each float 39 *a,b* is raised sufficiently to open its respective needle valve assembly 40 *a,b*. When this occurs, the opening of needle valves 40 *a,b* allows accumulated drainage to flow slowly through the respective openings 41 *a,b* into mixing chamber 28. Each needle valve assembly 40 *a,b* includes a conventional ball check valve 57 *a,b*, respectively, in the opening 41 *a,b* to prevent the backup of fuel from the mixing chamber 28 into the drainage chamber 29.

The valve assemblies 40 *a,b* serve an additional function. Most outboard engines today no longer use pressurized fuel tanks. Instead, they have pumps, which suck fuel from the tank. This requires that there be no air inlets on the fuel tank, lest the vacuum needed to pass fuel become inordinately high. Drainage chamber 29, as shown, necessarily possesses vent 38. If valves 40 *a,b* were open at all times, the needed vacuum would be broken when no drainage covered openings 41 *a,b*. To prevent this, valves 40 *a,b* and floats 39 *a,b* cooperate to close valves 40 *a,b* and seal mixing chamber 28, whenever no drainage is available to perform that function, i.e., when the drainage level drops below a predetermined level.

At the top of the mixing chamber 28 there is mounted a diffuser plate 50 for dispersing the drainage as it flows out of each aperture 41 *a,b* in the drainage chamber 29. The diffuser plate 50 has a generally circular disc shape with a circular rim or side 51 which is slightly smaller in diameter than the inner diameter of the mixing chamber 28. Diffuser plate 50 includes a longitudinal channel 52 which is raised above the surface of the plate 50 and extends across the diameter of the plate. Channel 52 has a generally U-shaped cross section and is open at each end 53. Plate 50 is loosely mounted within the mixing chamber 28 by positioning such plate with its channel 52 resting on top of the nut 54 associated with valve 45. Since diffuser plate 50 and its channel 52 are sized slightly smaller than the inner diameter of the mixing chamber 28, the plate will be held substantially at the level of the valve 45, with the nut 54 being contained in the open end of channel 52. In this position, the top surface of channel 52 will be located directly below and proximate each of the openings 41 *a,b* from drainage chamber 29.

Diffuser plate 50 acts to disperse the drainage which drops out of the openings 41 *a,b* on to the top surface of the channel 52 of the plate, after which the drainage disperses in a thin film over the top of the plate, as shown by the arrows 55 in FIG. 3. Also, as shown by the arrows 55, the drainage falls off the side 51 of the plate 50 and mixes readily with the fuel in the mixing chamber 29.

It is noted that the channel 52 also acts as a baffle to prevent sloshing of the fuel in the mixing chamber 28. The ripple line 56 indicates the fuel level in the mixing chamber and also illustrates the manner whereby the channel 52 serves as a baffle.

In operation, this device is installed upon or near the transom of the boat on which the associated engine is used. Fuel from tank 26 enters mixing chamber 28 through inlet 36 until the level of fuel and oil mixture in mixing chamber 28 fills the chamber. The valve 45 can be opened so that the fuel does not rise above the fuel level 56. When the engine is started it draws fuel from mixing chamber 28 through line 24 to carburetor 15 by means of outlet 44.

When the engine is operating, a significant fraction of fuel entering the carburetor through line 24 fails to combust completely, and accumulates as drainage at the bottom of the crankcase from which it flows through line 23 and inlet 37 into drainage chamber 29. There, drainage accumulates until it reaches a level sufficiently high so that each valve assembly 40 *a,b* is actuated by its respective float 39 *a,b,* allowing some of the drainage to flow slowly through openings 41 *a,b* and onto the top of channel 52 in the mixing chamber 28. The drainage disperses in a thin film over the surface of the diffuser plate 50 as shown by arrows 55, and drops over the side 51 of the plate adjacent the inner wall of the chamber 28 in fine proportions to thereby mix readily with the fuel. In mixing chamber 28, the oil-rich drainage is distributed into a relatively large quantity of normal fuel/oil mixture flowing through mixing chamber 28 from tank 26 to carburetor 15.

Although the above description is directed to a preferred embodiment of the invention, it is noted that other variations and modifications will be apparent to those skilled in the art, and, therefore, may be made without departing from the spirit and scope of the present disclosure.

What is claimed is:

1. In a device for distributing drainage and the condensed vapor thereof from the induction system of an internal combustion engine to the fuel mixture delivered by a fuel system to the engine, said device including a mixing chamber having an inlet and an outlet passage, said mixing chamber being adapted to be connected in series with the fuel system, a drainage chamber adapted to receive drainage from the engine, means providing passage for drainage from said drainage chamber to the upper portion of said mixing chamber, the improvement of which comprises diffuser plate means located directly below said drainage passage means at a fixed elevation in the upper end of said mixing chamber, said diffuser plate means having an upper surface for receiving the drainage flowing from said passage means and dispersing said drainage in a thin film which descends from the periphery of the diffuser plate means, whereby said drainage mixes readily with the fuel in said mixing chamber.

2. A device as recited in claim 1 wherein said upper surface of said diffuser plate means extends in a substantially horizontal direction throughout the interior of the mixing chamber with said periphery of the diffuser plate means being spaced from the walls of the mixing chamber.

3. A device as recited in claim 2, wherein said diffuser plate means comprises a generally disc-shaped plate having a longitudinal channel which is raised above the surface of said plate and extends across the diameter of said plate, whereby the drainage flowing from said passage means falls on to the top surface of said channel after which it disperses in a thin film over the top of said plate.

4. A device as recited in claim 3, wherein said diffuser plate means is mounted near the top of said mixing chamber at substantially the same level set by a fuel level valve.

5. A device as recited in claim 4 wherein said device has a partition wall directly above said diffuser plate means for separating said drainage chamber from said mixing chamber, said means providing passage for drainage including at least two valves mounted in said partition wall through which said drainage flows to said upper surface of said diffuser plate means, said valves being spaced from each other.

6. A device as recited in claim 5 wherein said diffuser plate means includes a plate on which the drainage is dispersed in a thin film, and a baffle for the fuel in the mixing chamber, said baffle including a longitudinal channel extending along the top of said plate.

7. A device as recited in claim 6, wherein said diffuser plate means is positioned near the top of said mixing chamber by an extension means securely mounted to the inside wall of said mixing chamber, with the longitudinal channel resting on top of said extension means.

8. A device as recited in claim 2, further comprising valve means associated with said passage means for blocking said passage means upon there being less than a predetermined level of drainage in said drainage chamber and allowing the flow of drainage from said drainage chamber to said mixing chamber through said passage means upon there being more than a predetermined level of flow in said drainage chamber.

9. A device as recited in claim 8 wherein said valve means includes a check valve for preventing the backup of fuel from said mixing chamber into said drainage chamber.

* * * * *

UNITED STATES PATENT AND TRADEMARK OFFICE

CERTIFICATE OF CORRECTION

PATENT NO. : 3,976,040

DATED : August 24, 1976

INVENTOR(S) : Charles P. Goggi

It is certified that error appears in the above-identified patent and that said Letters Patent are hereby corrected as shown below:

Col. 4, Line 11, "rns" should be --runs--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*